US008235750B2

(12) United States Patent
Osaki

(10) Patent No.: US 8,235,750 B2
(45) Date of Patent: Aug. 7, 2012

(54) COAXIAL INSPECTION CONNECTOR AND RECEPTACLE

(75) Inventor: Yoshihiro Osaki, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/188,660

(22) Filed: Jul. 22, 2011

(65) Prior Publication Data

US 2012/0021644 A1 Jan. 26, 2012

(30) Foreign Application Priority Data

Jul. 22, 2010 (JP) ..... 2010-164860

(51) Int. Cl.
*H01R 9/05* (2006.01)

(52) U.S. Cl. ..... 439/578; 439/219; 439/188; 439/912; 439/916; 439/944

(58) Field of Classification Search ..... 439/219, 439/916, 912, 944
See application file for complete search history.

(56) References Cited

U.S. PATENT DOCUMENTS 6,554,630 B2 * 4/2003 Uratani ..... 439/188
7,556,529 B2 * 7/2009 Wakamatsu et al. ..... 439/578
7,637,774 B1 * 12/2009 Vaccaro ..... 439/578
7,692,508 B2 * 4/2010 Quan et al. ..... 333/1
2012/0021644 A1 * 1/2012 Osaki ..... 439/578

FOREIGN PATENT DOCUMENTS

JP 11-265761 A 9/1999
JP 2009-129690 A 6/2009
JP 2009-158176 A 7/2009

* cited by examiner

*Primary Examiner* — James Harvey

(74) *Attorney, Agent, or Firm* — Studebaker & Brackett PC; Tim L. Brackett, Jr.; John F. Guay

(57) ABSTRACT

This disclosure provides a coaxial inspection connector that is connectable to and disconnectable from a receptacle, the receptacle including an external conductor, a fixed terminal, and a movable terminal that is in pressed contact with the fixed terminal from below. Housing includes an end portion that contacts the external conductor. A probe extends vertically in the end portion. The probe is insulated from the housing, and includes a plunger. The plunger includes a plunger body and a tip. The plunger body contacts the fixed terminal when the external conductor contacts the end portion. The tip is an insulating portion disposed at a lower end of the plunger. The tip pushes the movable terminal downward and separates the movable terminal from the fixed terminal when the external conductor contacts the end portion.

7 Claims, 7 Drawing Sheets

COAXIAL INSPECTION CONNECTOR AND RECEPTACLE

CROSS REFERENCE TO RELATED APPLICATIONS

The present application claims priority to Japanese Patent Application No. 2010-164860 filed Jul. 22, 2010, the entire contents of which is incorporated herein by reference in its entirety.

FIELD OF THE INVENTION

This disclosure relates to a coaxial inspection connector, and in particular, to a coaxial inspection connector that is connectable to and disconnectable from a receptacle, which is an object to be inspected. This disclosure also relates to the receptacle.

BACKGROUND

Japanese Unexamined Patent Application Publication No. 2009-129690 describes an inspection plug connector, which is an example of existing coaxial inspection connectors. FIG. 12 is a sectional view of an inspection plug connector 500 and a connector 600 with switch, illustrating a state in which the inspection plug connector 500 is not connected to the connector 600 with switch. FIG. 13 is a plan view of the connector 600 with switch, illustrating a state in which the inspection plug connector 500 is not connected to the connector 600 with switch. FIG. 14 is a plan view of the inspection plug connector 500 and the connector 600 with switch, illustrating a state in which the inspection plug connector 500 is connected to the connector 600 with switch. FIG. 15 is a sectional view of the connector 600 with switch, illustrating a state in which the inspection plug connector 500 is connected to the connector 600 with switch. FIG. 16 is a sectional view of the inspection plug connector 500 and the connector 600 with switch, illustrating a state in which the inspection plug connector 500 is connected to the connector 600 with switch.

As illustrated in FIGS. 12 to 15, the inspection plug connector 500 includes a probe 502, a conductive shell 504, and an insulation housing 506. The conductive shell 504 is made of a conductive material and has a substantially cylindrical shape. The probe 502 extends through the conductive shell 504 and protrudes from an end of the conductive shell 504. The probe 502 includes a conductive portion 502*a* and a nonconductive portion 502*b*. As illustrated in FIG. 12, the conductive portion 502*a* is in the left half of the probe 502, and the nonconductive portion 502*b* is in the right half of the probe 502. The insulation housing 506 is disposed in the conductive shell 504 and insulates the probe 502 from the conductive shell 504.

As illustrated in FIGS. 12 to 15, the connector 600 with switch includes an insulation housing 602, a conductive shell 604, and movable contacts 606 and 608 (see FIG. 15). The insulation housing 602 is the body of the connector 600 with switch. The conductive shell 604 is made of a conductive material and has a substantially cylindrical shape. The conductive shell 604 is disposed on the insulation housing 602. The movable contacts 606 and 608 include elastic contact pieces 606*a* and 608*a* and conductive contact portions 606*b* and 608*b*, respectively. As illustrated in FIG. 13, the elastic contact pieces 606*a* and 608*a* contact the conductive contact portions 608*b* and 606*b*, respectively. Thus, the movable contact 606 and the movable contact 608 are connected to each other.

As illustrated in FIGS. 14 and 15, when inspecting the electrical characteristics of the movable contact 608 side of the connector 600 with switch, the probe 502 is inserted into the insulation housing 602 and the conductive shell 604 such that the conductive portion 502*a* is positioned on the left side and the nonconductive portion 502*b* is positioned on the right side. At this time, the conductive shell 604 is inserted into the conductive shell 504. Thus, the inner peripheral surface of the conductive shell 504 contacts the outer peripheral surface of the conductive shell 604, whereby the conductive shell 504 is connected to the conductive shell 604. As illustrated in FIG. 15, the probe 502 enters a space between the elastic contact pieces 606*a* and 608*a* and separates the elastic contact pieces 606*a* and 608*a* from the conductive contact portions 608*b* and 606*b*. At this time, as illustrated in FIG. 14, the conductive portion 502*a* contacts the elastic contact piece 608*a*, and the nonconductive portion 502*b* contacts the elastic contact piece 606*a*. Thus, the electrical characteristics of the movable contact 608 side can be inspected through the conductive portion 502*a* of the probe 502.

As illustrated in FIG. 16, when inspecting the electrical characteristics of the movable contact 606 side of the connector 600 with switch, the probe 502 is inserted into the insulation housing 602 and the conductive shell 604 such that the conductive portion 502*a* is positioned on the right side and the nonconductive portion 502*b* is positioned on the left side. At this time, the conductive shell 604 is inserted into the conductive shell 504. Thus, the inner peripheral surface of the conductive shell 504 contacts the outer peripheral surface of the conductive shell 604, whereby the conductive shell 504 is connected to the conductive shell 604. The probe 502 enters a space between the elastic contact pieces 606*a* and 608*a*, and separates the elastic contact pieces 606*a* and 608*a* from the conductive contact portions 608*b* and 606*b*. At this time, as illustrated in FIG. 16, the conductive portion 502*a* contacts the elastic contact piece 606*a*, and the nonconductive portion 502*b* contacts the elastic contact piece 608*a*. Therefore, the electrical characteristics of the movable contact 606 side can be inspected through the conductive portion 502*a* of the probe 502.

The inspection plug connector 500 is capable of inspecting the electrical characteristics of the movable contact 606 side and the movable contact 608 side.

SUMMARY

The present disclosure provides a coaxial inspection connector that is capable of inspecting the electrical characteristics of a fixed terminal side of a receptacle in which a movable terminal is in pressed contact with the fixed terminal from vertically below, and the receptacle.

In an embodiment of the disclosure, a coaxial inspection connector is connectable to and disconnectable from a receptacle, the receptacle including an external conductor that is substantially cylindrical, a fixed terminal, and a movable terminal that is in pressed contact with the fixed terminal from vertically below. The coaxial inspection connector includes a housing including an end portion that contacts the external conductor, the end portion being substantially cylindrical; and a probe that extends vertically in the end portion, the probe being insulated from the housing. The probe includes a conductive portion that contacts the fixed terminal with the external conductor contacting the end portion, and an insulating portion provided at a lower end of the probe. The insulating portion pushes the movable terminal vertically downward and separates the movable terminal from the fixed terminal with the external conductor contacting the end portion.

In another embodiment of the disclosure, a receptacle is connectable to and disconnectable from the coaxial inspection connector. The receptacle includes a body, an external conductor that is disposed vertically above the body, the external conductor being substantially cylindrical, a fixed terminal provided on the body, and a movable terminal that is in pressed contact with the fixed terminal from vertically below in a region surrounded by the external conductor in plan view as seen from vertically above. A part of a lower surface of the fixed terminal in the vertical direction is in contact with the body in the region in which the movable terminal contacts the fixed terminal.

With embodiments of the disclosure, the electrical characteristics of a fixed terminal side of a receptacle in which a movable terminal is in pressed contact with the fixed terminal from vertically below can be inspected.

Other features, elements, characteristics and advantages will become more apparent from the following detailed description with reference to the attached drawings.

DETAILED DESCRIPTION

The inventors realized that the inspection plug connector described in Japanese Unexamined Patent Application Publication No. 2009-129690 is incapable of inspecting the electrical characteristics of a fixed terminal side of a general coaxial connector, for example, a coaxial connector described in Japanese Unexamined Patent Application Publication No. 11-265761, in which a movable terminal (which corresponds to the elastic contact piece) is in pressed contact with a fixed terminal (which corresponds to the conductive contact portion) from vertically below. More specifically, in the coaxial connector described in Japanese Unexamined Patent Application Publication No. 11-265761, the movable terminal is in pressed contact with the fixed terminal from vertically below. When the movable terminal is pushed down by the above-described probe 502, the movable terminal is separated from the fixed terminal. If the inspection plug connector 500 is used for such a coaxial connector and when the probe 502 contacts the movable terminal, both the conductive portion 502*a* and the nonconductive portion 502*b* contact the movable terminal. Therefore, the inspection plug connector 500 is incapable of inspecting the electrical characteristics of the fixed terminal side, although the inspection plug connector 500 is capable of inspecting the electrical characteristics of the movable terminal side.

Figure 1:
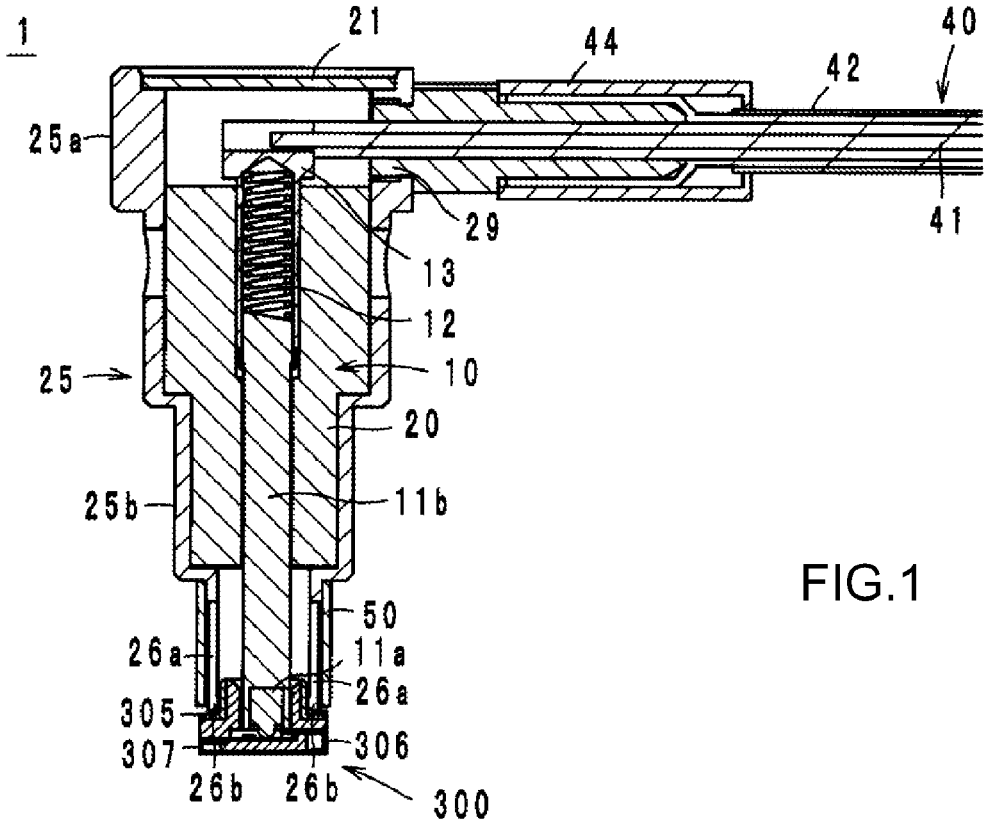
FIG. 1 is a sectional view of a coaxial inspection connector according to an exemplary embodiment.
Figure 2:
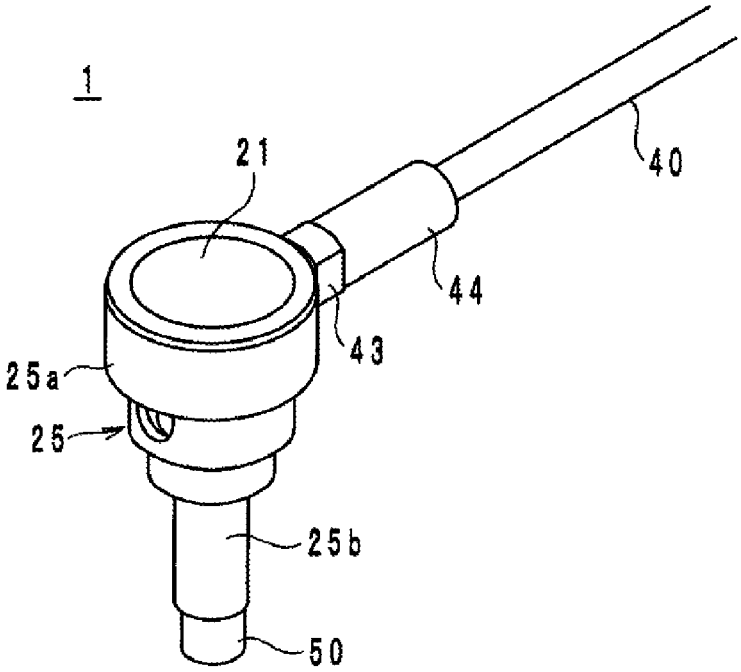
FIG. 2 is an external perspective view of the coaxial inspection connector.
Figure 3:
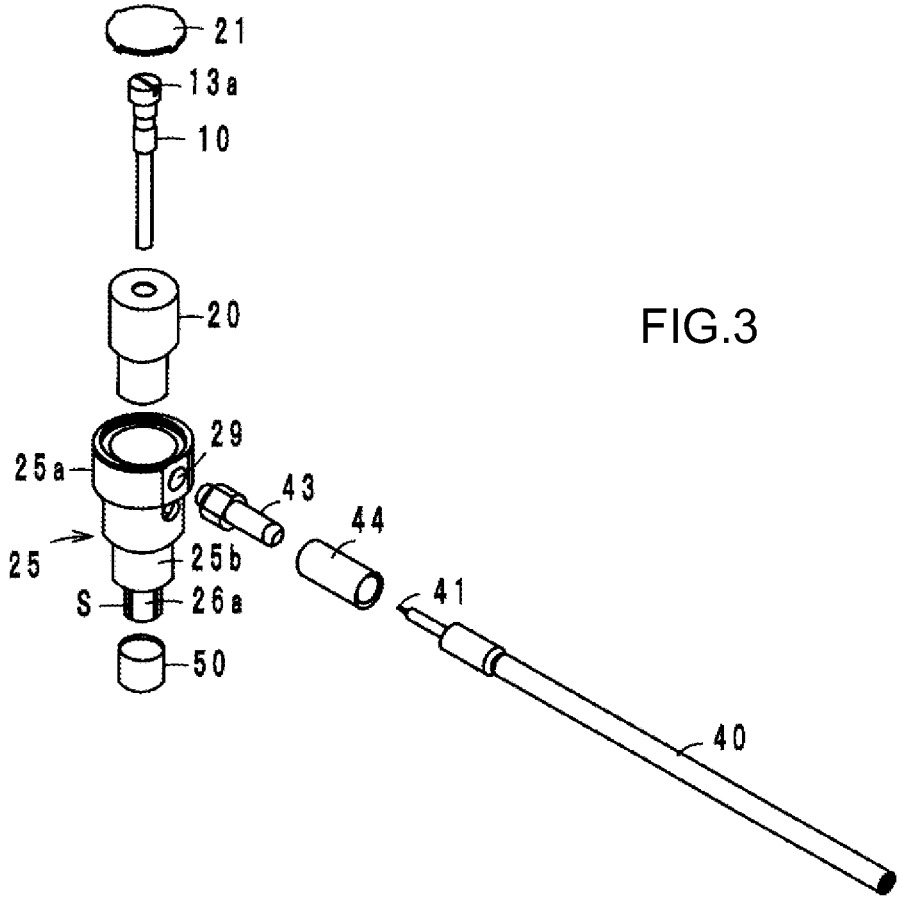
FIG. 3 is an exploded perspective view of the coaxial inspection connector.
Figure 4:
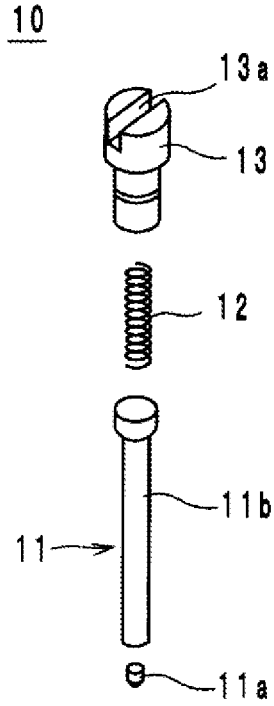
FIG. 4 is an exploded perspective view of a probe of the coaxial inspection connector.

Hereinafter, the structure of a coaxial inspection connector according to an exemplary embodiment that addresses the above-noted shortcoming will be described with reference to the drawings. FIG. 1 is a sectional view of a coaxial inspection connector 1 according to an exemplary embodiment. FIG. 2 is an external perspective view of the coaxial inspection connector 1. FIG. 3 is an exploded perspective view of the coaxial inspection connector 1. FIG. 4 is an exploded perspective view of a probe 10 of the coaxial inspection connector 1. The direction in which the probe 10 of the coaxial inspection connector 1 extends in FIGS. 1 and 2 will be referred to as the vertical direction.

The coaxial inspection connector 1 is connectable to and disconnectable from a receptacle, which is an object to be inspected. As illustrated in FIGS. 1 to 3, the coaxial inspection connector 1 includes the probe 10, a bushing 20, a disk 21, a housing 25, and a restraining member 50. As illustrated in FIGS. 1 and 4, the probe 10 includes a plunger 11, a coil spring 12, and a barrel 13. As illustrated in FIGS. 1 and 4, the plunger 11 includes a plunger body 11*b* and a tip 11*a*.

The plunger body 11*b* is a pin made of beryllium copper and having a flat head. The plunger serves as a conductive portion. As illustrated in FIGS. 1 and 4, a part of the plunger body 11*b* near the lower end thereof is substantially cylindrical.

The tip 11*a* is disposed at the lower end of the probe 10. The tip 11*a* is made of an insulating material such as a resin and serves as an insulating portion. The tip 11*a* has a substantially cylindrical shape having a protrusion that protrudes downward from the bottom surface thereof. The tip 11*a* is attached to the plunger body 11*b* by being inserted into the lower end of the plunger body 11*b*. At this time, the lower end of the tip 11*a* is located below the lower end of the plunger body 11*b*. The lower end of the plunger body 11*b* surrounds the tip 11*a* in plan view as seen in the vertical direction.

The barrel 13 is a substantially cylindrical member made of brass and having an opening in a lower side thereof. The plunger 11 and the coil spring 12 are inserted into the barrel 13. Thus, when a pressure is applied to the plunger 11 from below, the coil spring 12 contracts, and the plunger 11 can be retracted upward.

A groove 13*a* is formed in the upper surface of the barrel 13. As illustrated in FIG. 1, a center conductor 41 of a coaxial cable 40 is inserted into the groove 13*a* and soldered, whereby the center conductor 41 is connected to the barrel 13. The outer peripheral surface of the plunger 11 near the upper end thereof is in contact with the inner peripheral surface of the cylinder portion of the barrel 13, whereby the plunger 11 is electrically connected to the center conductor 41 through the barrel 13.

As illustrated in FIGS. 1 to 3, the housing 25 has an upper portion 25*a* and a lower portion 25*b*. The upper portion 25*a* is a substantially cylindrical portion having a relatively large diameter and made of a conductive material (for example, beryllium copper). An opening 29 is formed in a side surface of the upper portion 25*a*. The lower portion 25*b* is integrally formed with the upper portion 25*a* and disposed below the upper portion 25*a*. The lower portion 25*b* is a substantially cylindrical portion having a relatively small diameter and made of a conductive material (for example, beryllium copper). The upper portion 25*a* and the lower portion 25*b* are electrically connected to a shield conductor 42 of the coaxial cable 40 through an adapter 43.

As illustrated in FIGS. 1 and 3, the lower portion 25*b* includes an end portion 26*a* and a protrusion 26*b*. The end portion 26*a* is at the lower end of the lower portion 25*b*. An external conductor of a receptacle, which will be described below, is inserted into the end portion 26*a*. The end portion 26*a* is substantially cylindrical and has a diameter that is smaller than that of a part of the lower portion 25*b* excluding the end portion 26*a*. The diameter of the end portion 26*a* can be increased and decreased. To be specific, as illustrated in FIG. 3, slits S are formed in the end portion 26*a* so as to extend upward from the bottom of the end portion 26*a*. The slits S can be widened due to the elasticity of the end portion 26*a*, and the end portion 26*a* can be widened horizontally. As illustrated in FIG. 1, the protrusion 26*b* protrudes from the inner peripheral surface at the end of the end portion 26*a* toward the center of the end portion 26*a*.

As illustrated in FIGS. 1 and 3, the disk 21 is disposed so as to close an opening on the upper side of the upper portion 25*a* of the housing 25.

The bushing 20 is a substantially cylindrical member made of an insulating material such as a resin. As illustrated in FIG. 1, the probe 10 is inserted into and fixed to the bushing 20. The probe 10 protrudes from an end of the bushing 20.

As illustrated in FIG. 1, the bushing 20, into which the probe 10 is inserted, is inserted into and fixed to the housing 25, which is substantially cylindrical. Because the bushing 20 is made of an insulating material, the probe 10 is insulated from the housing 25. The plunger 11 extends through the end portion 26*a* of the housing 25 and protrudes from the end portion 26*a*.

As illustrated in FIGS. 1 to 3, the restraining member 50 is substantially cylindrical and is attached to the housing 25. To be specific, the inside diameter of the restraining member 50 is larger than the outside diameter of the end portion 26*a*. The restraining member 50 is fixed to the housing 25 by being press-fitted into the lower portion 25*b* of the housing 25 from the end portion 26*a* side (i.e., from below). Thus, the restraining member 50 surrounds the end portion 26*a*. That is, the inner peripheral surface of the restraining member 50 faces the outer peripheral surface of the end portion 26*a*. The restraining member 50 serves to restrain the diameter of the end portion 26*a* from being increased excessively when the coaxial inspection connector 1 is connected to a receptacle.

Referring to FIGS. 3 and 4, an exemplary process of assembling the coaxial inspection connector 1 will be described.

As illustrated in FIG. 4, the plunger 11 is assembled by attaching the tip 11*a* to an end of the plunger body 11*b*. The probe 10 is assembled by inserting the coil spring 12 and the plunger 11 into the barrel 13 from below. As illustrated in FIG. 3, the probe 10 is inserted into the center hole in the bushing 20 from above. The bushing 20 is inserted into the center hole in the housing 25 from above.

As illustrated in FIG. 3, the center conductor 41 of the coaxial cable 40 is inserted into the housing 25 through the opening 29 (see FIG. 1) and soldered to the groove 13*a* in the barrel 13. Thus, the center conductor 41 is electrically connected to the plunger 11 through the barrel 13 and the coil spring 12. The adapter 43, which is connected to the shield conductor 42 of the coaxial cable 40, is fitted into the opening 29 in the housing 25, and a ring 44 is crimped to the outer periphery of the adapter 43. As a result, the shield conductor 42 is electrically connected to the housing 25 through the adapter 43. A connector (not shown) for connecting the coaxial cable 40 to a measuring apparatus, is attached to the other end of the coaxial cable 40.

As illustrated in FIG. 3, the disk 21 is placed on the housing 25. Finally, the restraining member 50 is press-fitted into the lower portion 25*b* from below. Thus, assembling of the coaxial inspection connector 1 illustrated FIGS. 1 and 2 is completed.

Figure 5:
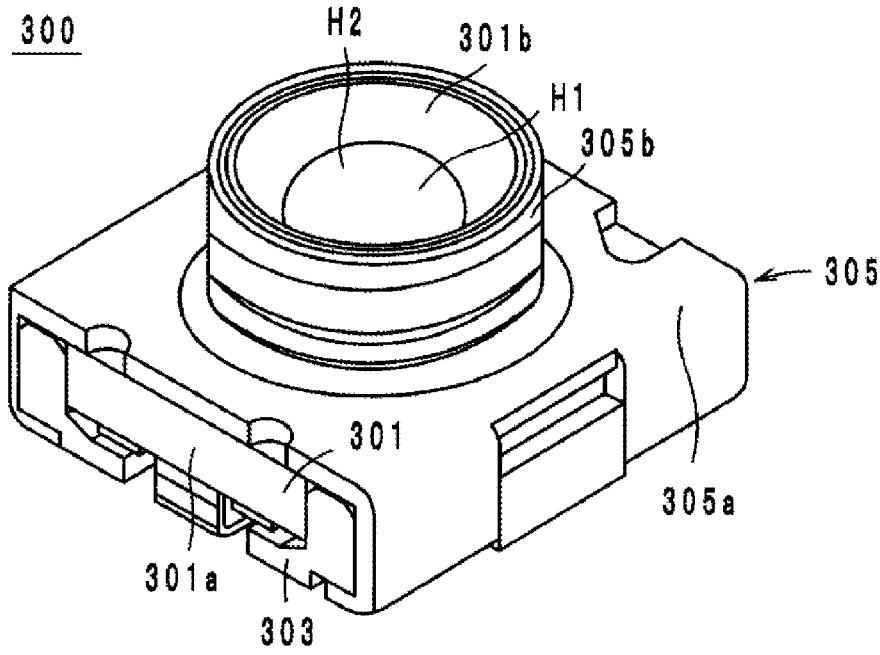
FIG. 5 is an external perspective view of a receptacle.
Figure 6:
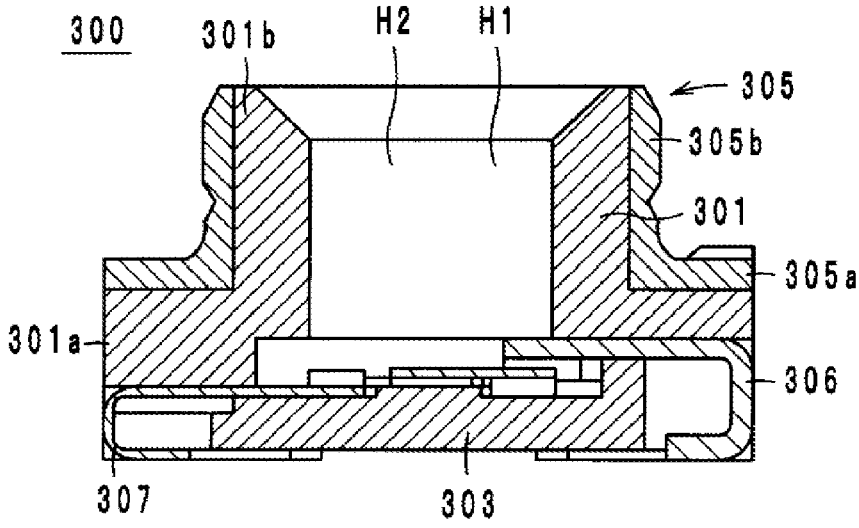
FIG. 6 is a sectional view of the receptacle.
Figure 7:
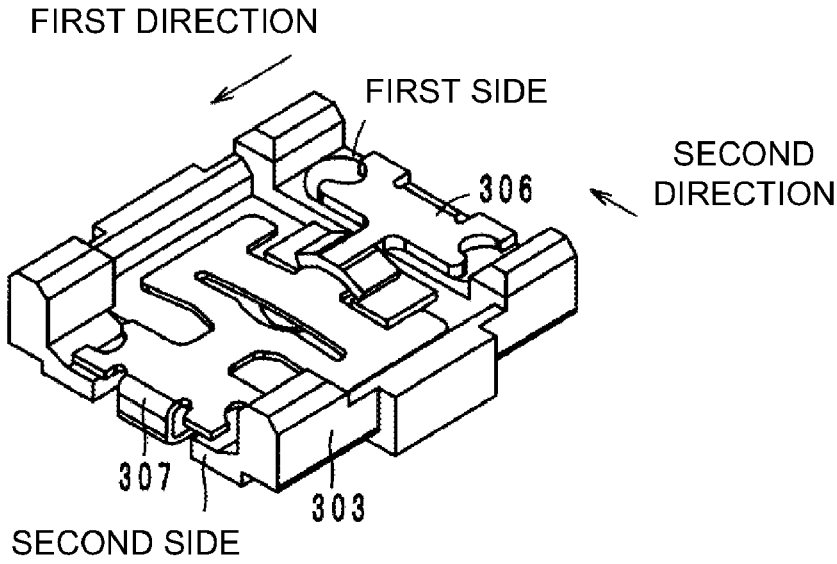
FIG. 7 is a perspective view of the receptacle from which an external conductor is removed.

The structure of a receptacle will be described with reference to the drawings. FIG. 5 is an external perspective view of a receptacle 300. FIG. 6 is a sectional view of the receptacle 300. FIG. 7 is a perspective view of the receptacle 300 from which an external conductor 305 is removed.

The receptacle 300 is, for example, a coaxial connector with switch that is disposed between an antenna and a transmitter/receiver circuit of a mobile phone. As illustrated in FIGS. 5 to 7, the receptacle 300 includes an upper case 301, a lower case 303, the external conductor 305, a fixed terminal 306, and a movable terminal 307.

The upper case 301 and the lower case 303 constitute a body of the receptacle 300 and are made of an insulating material such as a resin. As illustrated in FIGS. 6 and 7, the lower case 303 is a substantially rectangular plate-shaped member and forms the bottom surface of the receptacle 300. As illustrated in FIGS. 5 and 6, the upper case 301 is disposed above the lower case 303, and includes a plate-shaped portion 301*a* and a cylinder portion 301*b*. The plate-shaped portion 301*a* is a substantially rectangular plate-shaped member. The cylinder portion 301*b* is a substantially cylindrical member protruding upward from the plate-shaped portion 301*a*. A hole H1 is formed in the upper case 301 so as to extend through the plate-shaped portion 301*a* and the cylinder portion 301*b* vertically. The upper case 301 is superposed on the lower case 303 so that the lower surface of the plate-shaped portion 301*a* faces the upper surface of the lower case 303.

As illustrated in FIGS. 5 and 6, the external conductor 305 is disposed on the upper case 301, and includes a plate-shaped portion 305*a* and a cylinder portion 305*b*. The external conductor 305 is made of a conductive material (such as beryllium copper). The plate-shaped portion 305*a* includes a substantially rectangular plate portion and four fixing pieces and is substantially H-shaped. The cylinder portion 305*b* is substantially cylindrical and protrudes from the upper surface of the plate-shaped portion 305*a*. A hole H2 vertically extends through the external conductor 305.

The external conductor 305 serves as the upper surface of the receptacle 300 and fixes the upper case 301 and the lower case 303 to each other. To be specific, the external conductor 305 is attached to the upper case 301 and the lower case 303 so that the plate-shaped portion 301*a* overlaps the plate-shaped portion 305*a* and so that the cylinder portion 301*b* is contained in the hole H2 in the cylinder portion 305*b*. As illustrated in FIG. 5, the fixing pieces of the plate-shaped portion 305*a* are bent in a substantially U-shape so as to be curved from the upper surface of the upper case 301 to the lower surface of the lower case 303. Thus, the external conductor 305 clamps the upper case 301 and the lower case 303 in the vertical direction, and thereby fixes the upper case 301 and the lower case 303 to each other.

As illustrated in FIGS. 6 and 7, the fixed terminal 306 is disposed in the lower case 303 so as to extend from a first side of the lower case 303 toward a second side of the lower case 303 that faces the first side. The fixed terminal 306 is made of a conductive material (such as beryllium copper). As illustrated in FIG. 6, the fixed terminal 306 is fixed in place between the upper case 301 and the lower case 303 by being clamped by the upper case 301 and the lower case 303 in the vertical direction.

As illustrated in FIGS. 6 and 7, the movable terminal 307 extends from the second side of the lower case 303 toward the first side of the lower case 303. The movable terminal 307 is made of a conductive material (such as beryllium copper). As illustrated in FIG. 6, the movable terminal 307 is fixed in place between the upper case 301 and the lower case 303 by being clamped by the upper case 301 and the lower case 303 in the vertical direction.

Thus, the fixed terminal 306 and the movable terminal 307 are arranged in this order in a direction extending from the first side toward the second side of the lower case 303 (hereinafter referred to as a first direction). The fixed terminal 306 and the movable terminal 307 overlap each other in the vertical direction. The movable terminal 307 is a plate spring extending in a second direction that is a horizontal direction perpendicular to the first direction. To be specific, ends of the movable terminal 307 in the second direction are in contact with the upper surface of the lower case 303. A middle portion of the movable terminal 307 in the second direction is separated from the lower case 303. Thus, the movable terminal 307 is upwardly convex when seen in the first direction. As illustrated in FIGS. 6 and 7, a part of the movable terminal 307 that overlaps the fixed terminal 306 in the vertical direction is in pressed contact with the fixed terminal 306 from below. That is, the movable terminal 307 is electrically connected to the fixed terminal 306.

As can be seen from FIG. 6, the movable terminal 307 contacts the fixed terminal 306 in a region surrounded by the cylinder portion 305*b* of the external conductor 305 and the cylinder portion 301*b* of the upper case 301 (i.e., in the holes H1 and H2) in plan view as seen from vertically above. Moreover, as can be seen from FIG. 6, a part of the fixed terminal 306 is exposed in the holes H1 and H2 in plan view as seen from vertically above.

As illustrated in FIG. 7, a part of the lower surface of the fixed terminal 306 in the vertical direction is in contact with the upper surface of the lower case 303 in the region in which the movable terminal 307 contacts the fixed terminal 306.

The receptacle 300 is mounted, for example, on the motherboard of a mobile phone. At this time, the fixed terminal 306 is connected to an antenna and the movable terminal 307 is connected to a transmitter/receiver circuit.

Figure 8:
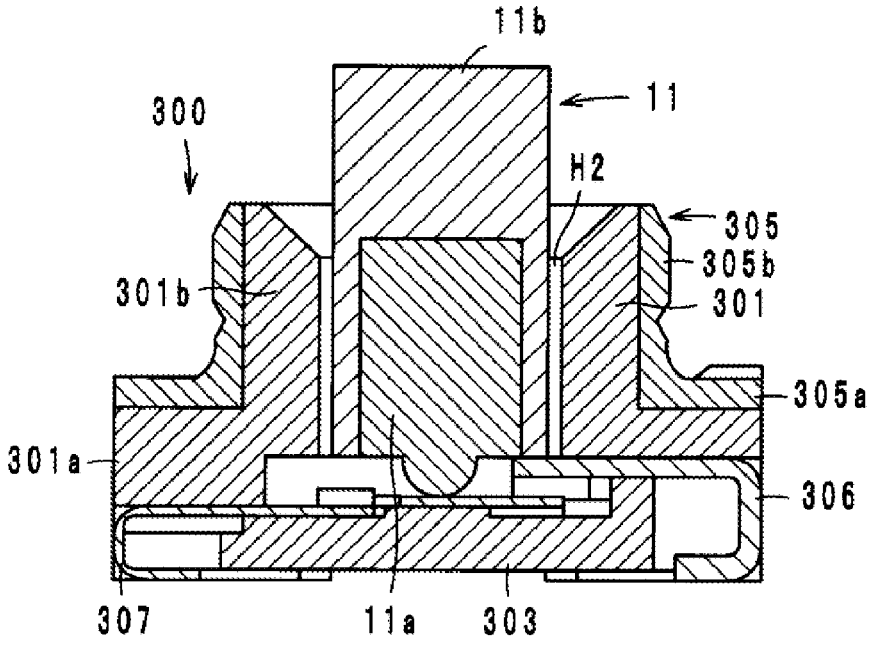
FIG. 8 is a sectional view of the receptacle and the coaxial inspection connector.
Figure 9:
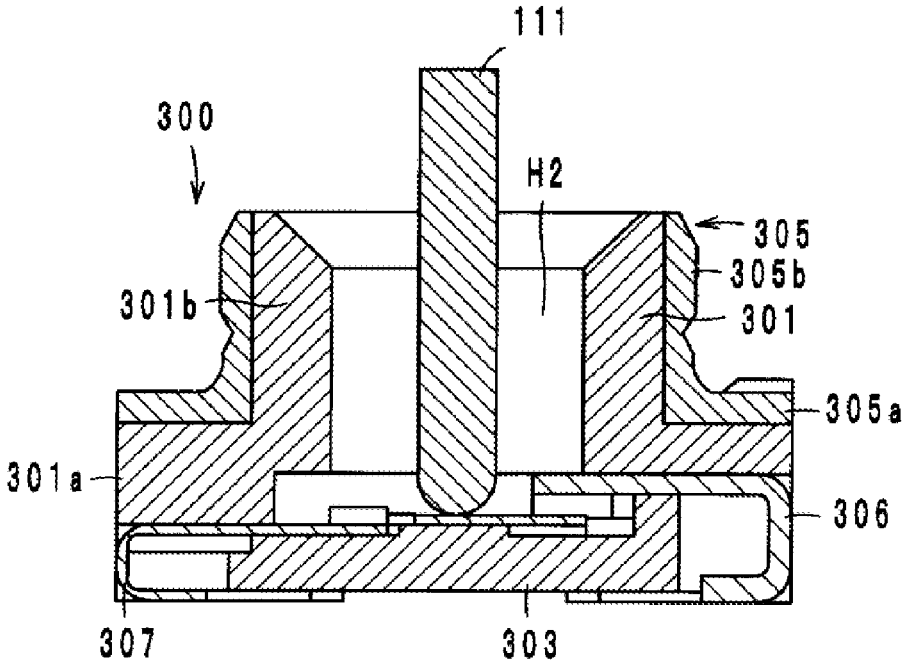
FIG. 9 is a sectional view of the receptacle and a coaxial inspection connector.

The operation of the coaxial inspection connector 1 will now be described with reference to the drawings. FIG. 8 is a sectional view of the receptacle 300 and the coaxial inspection connector 1. FIG. 9 is a sectional view of the receptacle 300 and a coaxial inspection connector 1'. In FIGS. 8 and 9, only portions of the plunger 11 and a plunger 111 of the coaxial inspection connectors 1 and 1' are illustrated and the details of the other members of the coaxial inspection connectors 1 and 1' are not shown.

As illustrated in FIG. 6, when the coaxial inspection connector 1 is not connected to the receptacle 300, the fixed terminal 306 is in contact with the movable terminal 307, whereby the antenna is electrically connected to the transmitter/receiver circuit.

A case of checking the electrical characteristics of the antenna will now be described. In this case, the coaxial inspection connector 1 is inserted into the receptacle 300 as described below.

As illustrated in FIG. 8, the plunger 11, which is connected to a measuring apparatus, is inserted into the hole H2 in the upper case 301 from above. At this time, as illustrated in FIG. 1, the cylinder portion 305*b* of the external conductor 305 is inserted into the end portion 26*a*. The inside diameter of the end portion 26*a* is slightly smaller than the outside diameter of the cylinder portion 305*b*. Therefore, the end portion 26*a* contacts the outer periphery of the cylinder portion 305*b*, and is slightly expanded by the cylinder portion 305*b*. When the end portion 26*a* is expanded, the outer periphery of the end portion 26*a* is pressed against the inner periphery of the restraining member 50. Thus, the restraining member 50 prevents the end portion 26*a* from being overexpanded. Then, the protrusion 26*b* engages with a groove that is formed in the outer periphery of the cylinder portion 305*b*. Thus, the coaxial inspection connector 1 is mated with the receptacle 300 with an appropriate force.

As described above, when the external conductor 305 contacts the end portion 26*a*, the lower end of the tip 11*a* of the plunger 11 contacts the movable terminal 307. Thus, as illustrated in FIG. 8, the tip 11*a* pushes the movable terminal 307 downward and separates the movable terminal 307 from the fixed terminal 306. Moreover, as illustrated in FIG. 8, when the external conductor 305 contacts the end portion 26*a*, the lower end of the plunger body 11*b* contacts the fixed terminal 306. As a result, the fixed terminal 306 is electrically disconnected from the movable terminal 307, and the plunger 11 (plunger body 11*b*) is electrically connected to the fixed terminal 306, whereby the antenna is connected to the measuring apparatus. At this time, the coil spring 12 is compressed by a reactive force from the movable terminal 307, and the plunger 11 is retracted upward. Thus, breakage of the movable terminal 307 is prevented.

Next, a case of checking the electrical characteristics of the transmitter/receiver circuit will be described. In this case, the coaxial inspection connector 1' illustrated in FIG. 9, which includes the plunger 111 made of a conductive material, is inserted into the receptacle 300 as described below. The members of the coaxial inspection connector 1' that are the same as those of the coaxial inspection connector 1 will be denoted by the same reference numerals.

As illustrated in FIG. 9, the plunger 111, which is connected to a measuring apparatus, is inserted into the hole H2 in the upper case 301 from above. At this time, the cylinder portion 305*b* of the external conductor 305 is inserted into the end portion 26*a*. The inside diameter of the end portion 26*a* is slightly smaller than the outside diameter of the cylinder portion 305*b*. Therefore, the end portion 26*a* contacts the outer periphery of the cylinder portion 305*b*, and is slightly expanded by the cylinder portion 305*b*. When the end portion 26*a* is expanded, the outer periphery of the end portion 26*a* is pressed against the inner periphery of the restraining member 50. Thus, the restraining member 50 prevents the end portion 26*a* from being overexpanded. Then, the protrusion 26*b* engages with the groove formed in the outer periphery of the cylinder portion 305*b*. Thus, the coaxial inspection connector 1' is mated with the receptacle 300 with an appropriate force.

As described above, when the external conductor 305 contacts the end portion 26*a*, the plunger 111 contacts the movable terminal 307. Thus, as illustrated in FIG. 9, the plunger 111 pushes the movable terminal 307 downward and separates the movable terminal 307 from the fixed terminal 306. As a result, the fixed terminal 306 is electrically disconnected from the movable terminal 307, and the plunger 111 is electrically connected to the movable terminal 307, whereby the transmitter/receiver terminal is connected to the measuring apparatus.

The coaxial inspection connector 1, which has the structure described above, is capable of inspecting the electrical characteristics of the fixed terminal 306 side of the receptacle 300, in which the movable terminal 307 is in pressed contact with the fixed terminal 306 from vertically below, as described below. To be specific, in the coaxial inspection connector 1, the plunger 11 has the tip 11*a*, which is made of an insulating material. Therefore, when the plunger 11 pushes the movable terminal 307 vertically downward, the tip 11*a* contacts the movable terminal 307. At this time, the plunger body 11*b* is not electrically connected to the movable terminal 307. However, the plunger body 11*b* contacts the fixed terminal 306. Therefore, the plunger body 11*b* is electrically connected to the fixed terminal 306. Therefore, the probe 10 is electrically connected to the fixed terminal 306. As a result, the coaxial inspection connector 1 is capable of inspecting the electrical characteristics of the fixed terminal 306 side of the receptacle 300, in which the movable terminal 307 is in pressed contact with the fixed terminal 306 from vertically below.

In the coaxial inspection connector 1, the lower end of the plunger body 11*b* in the vertical direction surrounds the tip 11*a* in plan view as seen vertically. Therefore, even if the coaxial inspection connector 1 is rotated around the probe 10, the plunger body 11*b* continuously contacts the fixed terminal 306. As a result, it is not necessary to orient the coaxial inspection connector 1 in a specific direction when connecting the coaxial inspection connector 1 to the receptacle 300.

Moreover, as illustrated in FIG. 7, a part of the lower surface of the fixed terminal 306 in the vertical direction is in contact with the upper surface of the lower case 303 in the region in which the movable terminal 307 contacts the fixed terminal 306. Therefore, even if the fixed terminal 306 is strongly pressed by the plunger body 11*b* from above, the fixed terminal 306 is not easily deformed elastically because the fixed terminal 306 is supported by the lower case 303.

Figure 10:
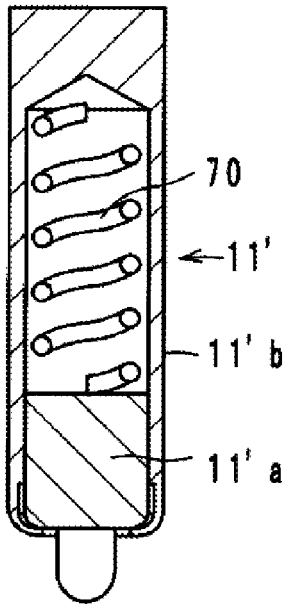
FIG. 10 is a sectional view of a plunger according to a modification.
Figure 11:
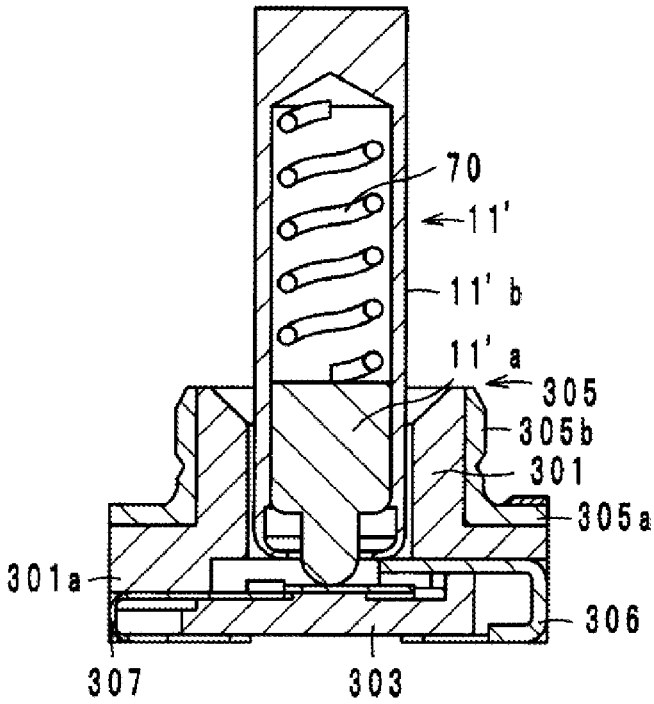
FIG. 11 is a sectional view illustrating a state in which the plunger according to the modification is in contact with a movable terminal of the receptacle.
Figure 12:
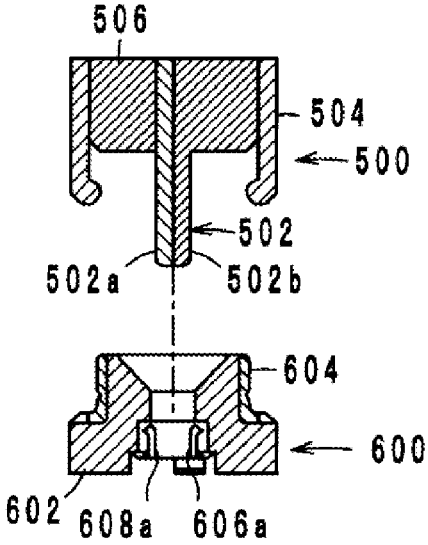
FIG.12 Prior Art
FIG. 12 is a sectional view of an inspection plug connector and a connector with switch, illustrating a state in which the inspection plug connector is not connected to the connector with switch.
Figure 13:
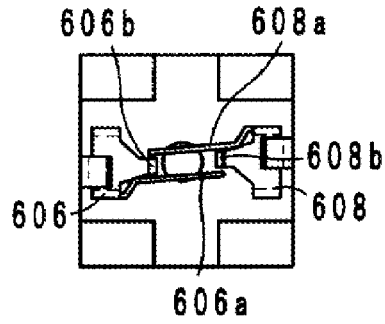
FIG.13 Prior Art
FIG. 13 is a plan view of the connector with switch, illustrating a state in which the inspection plug connector is not connected to the connector with switch.
Figure 14:
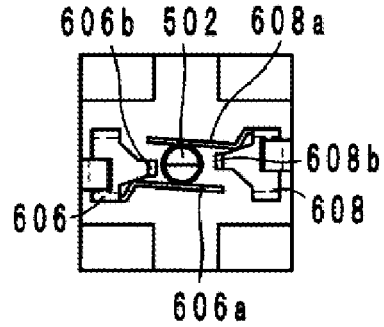
FIG.14 Prior Art
FIG. 14 is a sectional view of the inspection plug connector and the connector with switch, illustrating a state in which the inspection plug connector is connected to the connector with switch.
Figure 15:
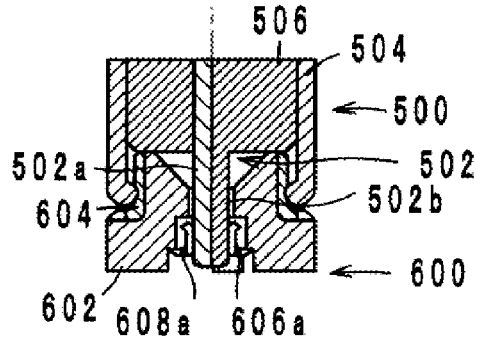
FIG.15 Prior Art
FIG. 15 is a plan view of the connector with switch, illustrating a state in which the inspection plug connector is connected to the connector with switch.
Figure 16:
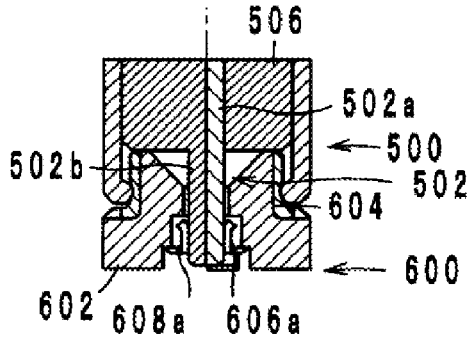
FIG.16 Prior Art
FIG. 16 is a sectional view of the inspection plug connector and the connector with switch, illustrating a state in which the inspection plug connector is connected to the connector with switch.

The plunger 11' according to an exemplary modification will now be described with reference to the drawings. FIG. 10 is a sectional view of the plunger 11' according to the exemplary modification. FIG. 11 is a sectional view of the plunger 11' according to the modification when the plunger 11' is in contact with the movable terminal 307.

As illustrated in FIG. 10, the plunger 11' includes an end portion 11'*a*, a plunger body 11'*b*, and a coil spring 70. The plunger body 11'*b* is a substantially cylindrical member made of brass and having an opening in the lower side thereof. The end portion 11'*a* and the coil spring 70 are inserted into the plunger body 11'*b*. Thus, when the movable terminal 307 is pressed against the end portion 11'*a* from below, the coil spring 70 contracts and the end portion 11'*a* is moved upward relative to the plunger body 11'*b*. Thus, breakage of the movable terminal 307 is prevented.

As heretofore described, embodiments consistent with the disclosure applicable to a coaxial inspection connector and a receptacle. In particular, embodiments can have an advantage in that the electrical characteristics of a fixed terminal side of a receptacle in which a movable terminal is in pressed contact with the fixed terminal from vertically below can be inspected.

While preferred embodiments have been described herein, it is to be understood that variations and modifications will be apparent to those skilled in the art without departing from the scope and spirit of the disclosure. The scope of the invention, therefore, is to be determined solely by the following claims and their equivalents.

What is claimed is:

1. A coaxial inspection connector that is connectable to and disconnectable from a receptacle, the receptacle including an external conductor that is substantially cylindrical, a fixed terminal, and a movable terminal that is in pressed contact with the fixed terminal from vertically below, the coaxial inspection connector comprising:

housing including an end portion that contacts the external conductor, the end portion being substantially cylindrical; and a probe that extends vertically in the end portion, the probe being insulated from the housing, wherein the probe includes a conductive portion that contacts the fixed terminal with the external conductor contacting the end portion, and an insulating portion provided at a lower end of the probe, the insulating portion pushing the movable terminal vertically downward and separating the movable terminal from the fixed terminal with the external conductor contacting the end portion.

2. The coaxial inspection connector according to claim 1, wherein a lower end of the conductive portion in a vertical direction surrounds the insulating portion in plan view as seen in the vertical direction and contacts the fixed terminal.

3. The coaxial inspection connector according to claim 1, wherein the insulating portion is movable vertically upward relative to the conductive portion.

4. The coaxial inspection connector according to claim 2, wherein the insulating portion is movable vertically upward relative to the conductive portion.

5. A receptacle that is connectable to and disconnectable from the coaxial inspection connector according to claim 1, the receptacle comprising:

a body;

an external conductor that is disposed vertically above the body, the external conductor being substantially cylindrical;

a fixed terminal disposed on the body; and a movable terminal that is in pressed contact with the fixed terminal from vertically below the fixed terminal in a region surrounded by the external conductor in plan view as seen from vertically above, wherein a part of a lower surface of the fixed terminal in the vertical direction is in contact with the body in the region.

6. A receptacle that is connectable to and disconnectable from the coaxial inspection connector according to claim 2, the receptacle comprising:

a body;

an external conductor that is disposed vertically above the body, the external conductor being substantially cylindrical;

a fixed terminal disposed on the body; and a movable terminal that is in pressed contact with the fixed terminal from vertically below the fixed terminal in a region surrounded by the external conductor in plan view as seen from vertically above, wherein a part of a lower surface of the fixed terminal in the vertical direction is in contact with the body in the region.

7. A receptacle that is connectable to and disconnectable from the coaxial inspection connector according to claim 3, the receptacle comprising:

a body;

an external conductor that is disposed vertically above the body, the external conductor being substantially cylindrical;

a fixed terminal disposed on the body; and a movable terminal that is in pressed contact with the fixed terminal from vertically below the fixed terminal in a region surrounded by the external conductor in plan view as seen from vertically above, wherein a part of a lower surface of the fixed terminal in the vertical direction is in contact with the body in the region.

* * * * *